US006382067B1

(12) United States Patent
Gagnon

(10) Patent No.: US 6,382,067 B1
(45) Date of Patent: May 7, 2002

(54) LUMBER POSITIONING APPARATUS FOR END TRIMMING

(75) Inventor: André Gagnon, Chicoutimi (CA)

(73) Assignee: Denis Compact Chicoutimi Inc., Chicoutimi (CA)

( * ) Notice: Subject to any disclaimer, the term of this patent is extended or adjusted under 35 U.S.C. 154(b) by 0 days.

(21) Appl. No.: 09/618,342

(22) Filed: Jul. 18, 2000

(30) Foreign Application Priority Data

Jun. 13, 2000 (CA) ..... 2311406

(51) Int. Cl.[7] ..... B27B 5/04; B26D 7/01

(52) U.S. Cl. ..... 83/732; 83/75.5; 83/76.8; 83/363; 83/367; 83/371; 83/425.2; 83/435.2; 83/446; 83/468.6; 198/456; 144/357; 144/245.2; 144/250.2

(58) Field of Search ..... 83/75.5, 76.8, 83/74, 363, 367, 368, 371, 373, 370, 732, 425.2, 426, 435.2, 438, 446, 444, 467.1, 468.5, 468.6, 508.1; 144/357, 356, 245.2, 250.17, 250.2; 198/456, 457.06

(56) References Cited

U.S. PATENT DOCUMENTS 2,253,453 A * 8/1941 Van Deinse ..... 83/435.2 X
2,920,737 A * 1/1960 Engleson et al. ..... 198/456
3,033,341 A * 5/1962 Cromeens ..... 83/732 X
3,584,664 A 6/1971 Bo Holmberg ..... 143/41
3,756,297 A 9/1973 Heikinheimo ..... 144/312
3,813,980 A 6/1974 Rand et al. ..... 83/467
4,164,248 A * 8/1979 Rysti ..... 83/367 X
4,231,460 A * 11/1980 Heikinheimo ..... 83/367 X
4,945,797 A * 8/1990 Hahn ..... 83/75.5
5,099,896 A * 3/1992 Ritola ..... 83/370 X
5,142,955 A 9/1992 Hale ..... 83/75.5
5,381,712 A * 1/1995 Head, Jr. et al. ..... 83/367 X
5,785,102 A * 7/1998 Hamel ..... 83/76.8 X
5,865,080 A * 2/1999 Jackson ..... 83/74
5,911,302 A * 6/1999 Jackson ..... 198/456
6,173,829 B1 * 1/2001 Jackson et al. ..... 198/456
6,311,828 B1 * 11/2001 Newnes et al. ..... 198/456

* cited by examiner

*Primary Examiner*—Boyer Ashley
(74) *Attorney, Agent, or Firm*—Merchant & Gould P.C.

(57) ABSTRACT

An apparatus for positioning lumber pieces for end trimming, by means of a succession of gates mounted on traveling chains set at a converging angle with the even end line of uniformly spaced lumber pieces carried transversely on parallel chains towards a multiple saw trimmer. The positioning is accomplished by any one gate pushing against the end of a lumber piece and then retracting when the lumber piece has reached the appropriate position for cutting by stationary trimming saws. The positioning process and the saw selection for each cut are scanner/computer controlled.

4 Claims, 5 Drawing Sheets

LUMBER POSITIONING APPARATUS FOR END TRIMMING

FIELD OF THE INVENTION

The present invention pertains to an apparatus for positioning lumber pieces for selective end trimming.

BACKGROUND OF THE INVENTION

In saw milling, the end trimming operation is the final sawing step before stacking lumber for drying. Its purpose is to cut the pieces into commercial lengths as determined by market demand in North America and overseas, while removing defects which would cause quality downgrading and therefore loss in value. In order to achieve the optimum value recovery, the lumber pieces are first scanned along their whole length to locate defects and to allow a computer to determine the cut to be made at each end of the piece by one of an array of saws disposed at a fixed spacing (ordinarily one or two feet) across the width of a lumber trimmer and therefore along the length of the pieces to be trimmed. Between the scanning and trimming sections, a lumber positioning system is provided along the lumber conveyor wherein each lumber piece is moved along its longitudinal axis so as to place its ends at a planned distance from two saws pre-selected by the computer in accordance with the original length of the pieces and the type of defects determined by the scanning means.

A most common method of positioning lumber for end trimming consists at present in placing power driven rolls parallelly to the conveying chains of the lumber conveyor and at a slightly higher elevation, (such as ⅛ of an inch) than that of the chains. Contact of these rolls with the underside of the lumber pieces causes them to move axially, across the chains, until reaching one of several adjustable bumper plates or fences placed side by side, which serve to define a particular cutting position for each piece. The frequency of this individual positioning is up to 2 per second in an average sized sawmill and reaches up to 3 per second in high speed lumber dressing operations for short wood (six to ten feet). In order to complete, within the available time, the necessary axial displacement of up to 2 feet for some pieces, an array of fast rotating 8 foot long rolls is required, plus a number of pneumatically actuated bumper plates disposed side by side along a distance at least equal to the length of the rolls. Sectional lifting skids are also needed between the chains so as to prevent further contact with the rolls for a piece that has reached its planned position within the positioning area.

A system such as described represents over two tons of mechanical equipment, with the necessary power input, a considerable supply of compressed air, plus the mechanical maintenance associated with a high speed operation generating heavy impact loads. Besides such inconveniences, this type of system is marginally accurate as the method of positioning the board by propelling it endwise against a stationary bumper produces a "bounce back" effect which varies with the weight of the piece and its acquired speed.

One example of this type of machine may be found described in U.S. Pat. No. 5,142,955 issued Sep. 1, 1992 to Hale.

OBJECTS AND STATEMENT OF THE INVENTION

An object of the present invention is to perform accurate endwise positioning of sawn lumber for the trimming operation; this is achieved by means of an apparatus which is much lighter than the one described above and does not involve high speed travel and abrupt stoppage of the material being positioned.

The lumber positioning apparatus of the present invention therefore comprises:

- a frame;
- carrying means for lumber positioning gates, mounted on the frame and drivingly associated in synchronism with the conveyor means;
- a series of successive lumber positioning gates operatively mounted to the gate carrying means; the gates being spaced at intervals corresponding to the uniform spacing of the lumber pieces of the conveyor means; and
- means responsive to scanner data and computer signals for selectively placing a positioning gate in a vertical position to contact an end of a lumber piece traveling on the conveyor means thereby displacing the lumber piece axially as it moves along the conveyor means; the scanner data responsive means further enabling the gate to be removed from the vertical position and thereby from engagement with the lumber piece whereby the lumber piece is no longer pushed axially as it continues to travel along the longitudinal conveyor direction towards the multiple saw trimmer.

In one preferred embodiment, the lumber positioning apparatus of the present invention is composed basically of a pair of parallel chains moving horizontally and joined together by evenly spaced cross bars at one end of which is mounted a pivoting plate, referred to as a "positioning gate". These chains are installed along one side of a multiple chain transfer which carries lumber pieces transversally and parallel to one another and at an even spacing from one another. The present invention requires that the lumber pieces first be brought to an even end line on one side of the chain transfer, that the spacing of the positioning gates be similar to that of the lumber pieces on the transfer chains, that the speed of the two chain systems be synchronized and that a converging angle be provided between the two chain systems, in their generally common direction of travel. Under these conditions, the position of any gate may be made to coincide at all times with the passage of each piece on the lumber transfer, causing the gate to make contact with and push the corresponding piece axially, as long as such gate is maintained in a vertical position by its actuating mechanism which, in turn, is computer controlled from the scanner data acquired upstream of the system. Whenever, somewhere along the length of the positioning apparatus, a piece has reached its correct position, a signal from the aforesaid computer control system causes the corresponding gate to cease contact by retracting itself to a horizontal position, leaving the piece to continue towards the trimming saws without further longitudinal movement.

In view of the low performance level of presently known systems as previously described, it can be said that a main object of this invention is to increase the accuracy of positioning of sawn lumber for the trimming operation, which has a direct effect on realizing the full potential value of each lumber piece.

In fact, if it is correctly estimated that the use of a scanner/computer combination to determine the optimum trimming pattern can increase the final product value by some 7% as compared to a visual/manual method, it is no less logical to think that the accuracy in actually locating the pieces with regard to the saws can be responsible for an important part of this gain.

Another object of the present invention is the reduction in size and weight of the necessary mechanical means to effect the positioning of the lumber, as well as the required floor space and power input.

Yet, a further object is to eliminate the high velocity movement of the individual pieces of lumber, terminating in a destructive impact upon reaching the locating bumper, thus at times causing sudden breakdowns of components with resulting losses of production.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
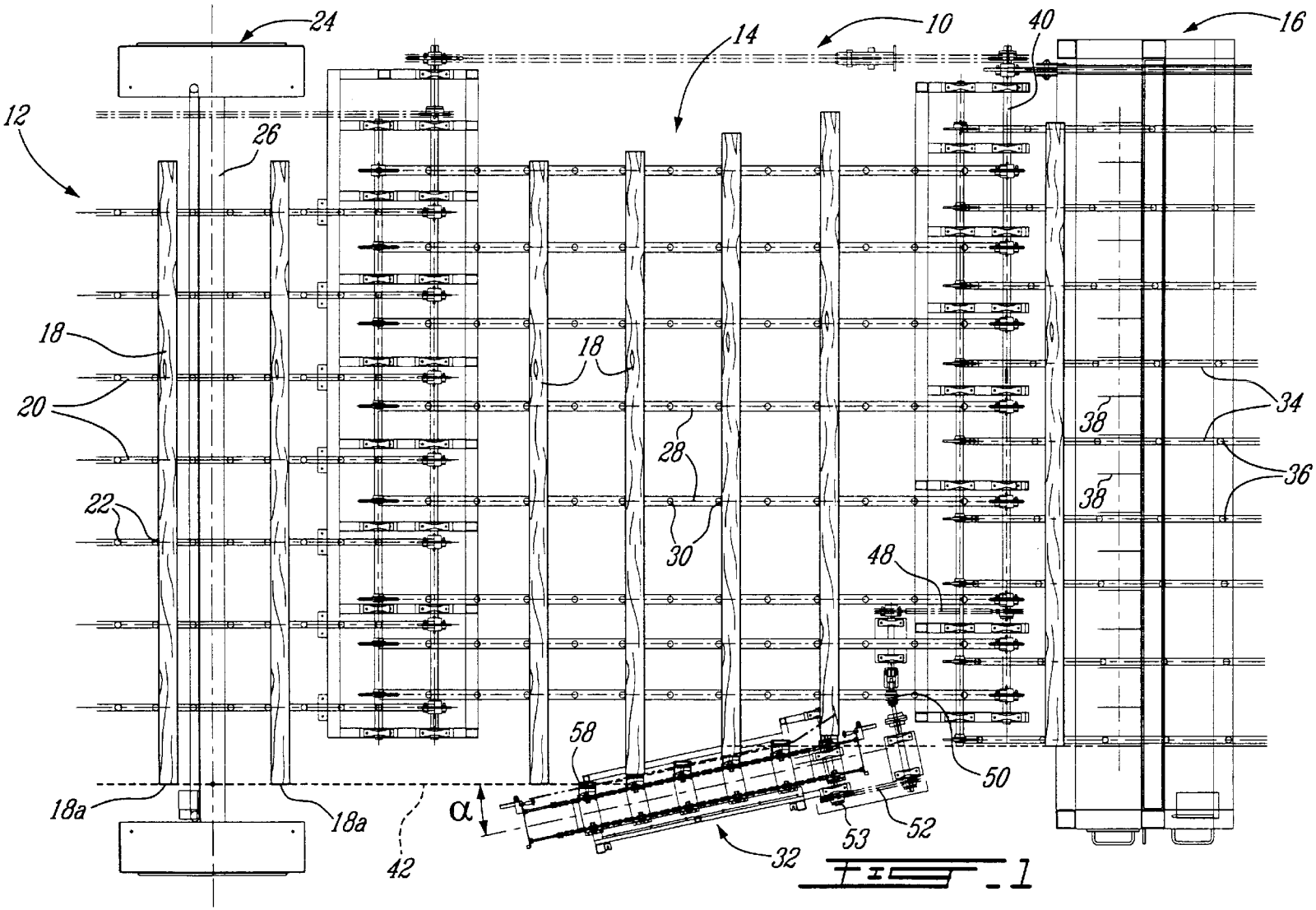
FIG. 1 is a schematic top plan view of a lumber trimming station using a positioning apparatus in accordance with the present invention.

Referring to FIG. 1, there is shown an overall view of a lumber trimming station, generally denoted 10, consisting of three lumber conveying sections 12, 14 and 16 which serve to convey lumber pieces 18 from a distributor (not shown) at the upstream end thereof to trimming saws 38 and further on to a lumber sorting station (not shown) at the downstream end thereof.

Section 12 comprises a series of parallelly disposed chains 20 each having a series of evenly spaced lugs 22 which serve to displace lumber pieces 18 through a scanning station, generally denoted 24. The scanning station which is well known in the art consists of a bridge type scanner having top and bottom scanning heads (the top supporting beam being shown as 26) between which the lumber pieces pass and are scanned along their length to provide information to a computer (not shown) associated with the scanner.

Each scanned lumber piece, which is now even ended on line 42, passes onto positioning section 14 of the trimming station, which is provided with a series of parallel chains 28, each equipped with a series of evenly spaced lumber contacting lugs 30. One end of the lumber pieces 18 reaches a positioning apparatus, generally denoted 32, which will be described in greater detail hereinbelow. Once the lumber pieces have been properly moved axially, as again described hereinbelow, they are conveyed to section 16 of the trimming station which is also provided with a series of chains 34, each having a series of lumber pushing lugs 36. Section 16 carries a battery of laterally spaced fixed saws 38 which are vertically moved in and out of sawing position in response to data received from the computer.

All chains 20, 28 and 36 of the lumber trimming station 10 are mechanically synchronized from a single driving unit (not shown).

The positioning apparatus 32 is shown in FIG. 1 as extending axially at a converging angle $\alpha$ with respect to an even end line 42 which is defined by the ends 18*a* of the lumber pieces 18 in the lumber scanning section 24 of the trimming station.

Figure 2:
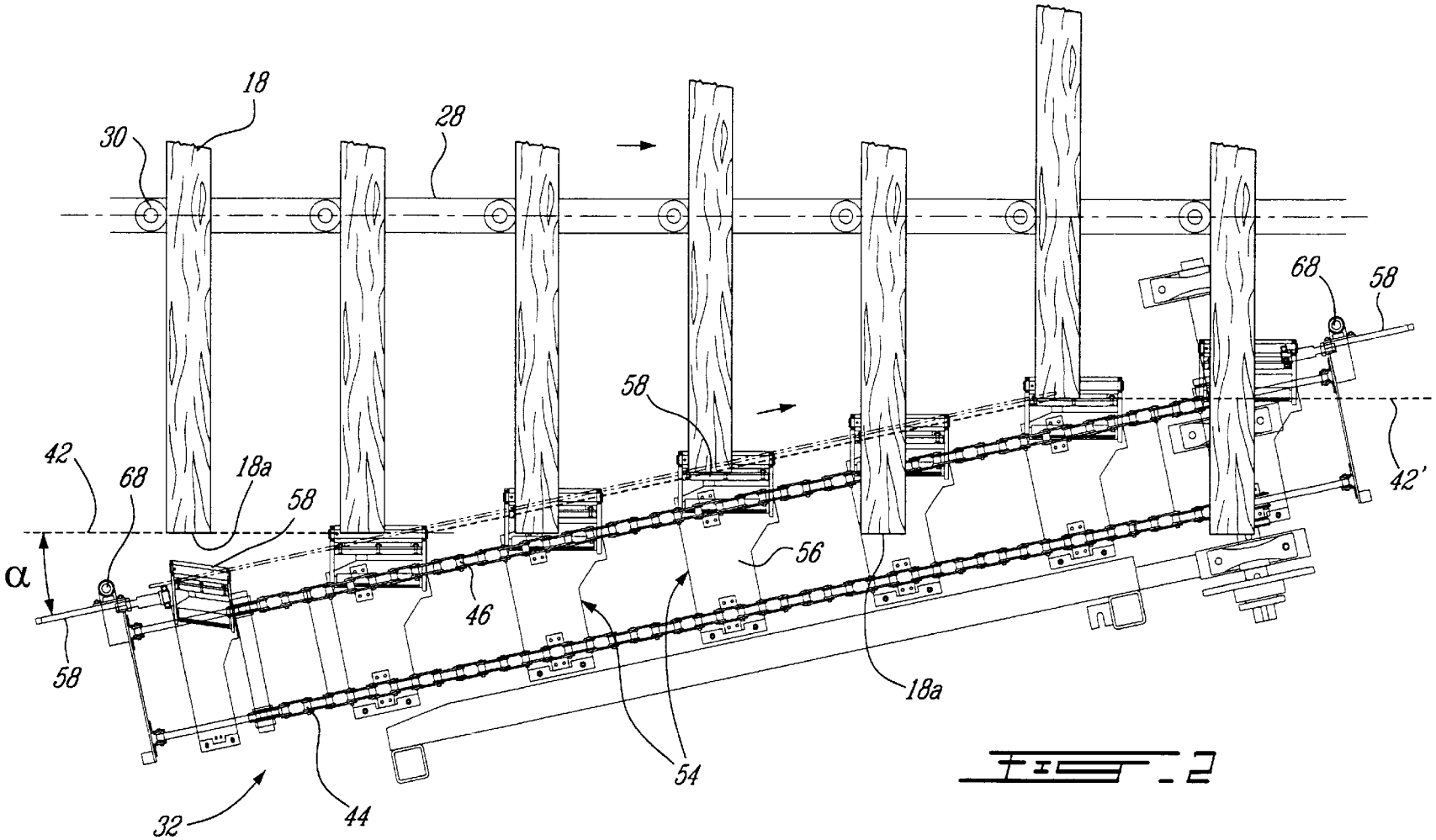
FIG. 2 is an enlarged schematic top plan view showing the positioning apparatus.
Figure 3:
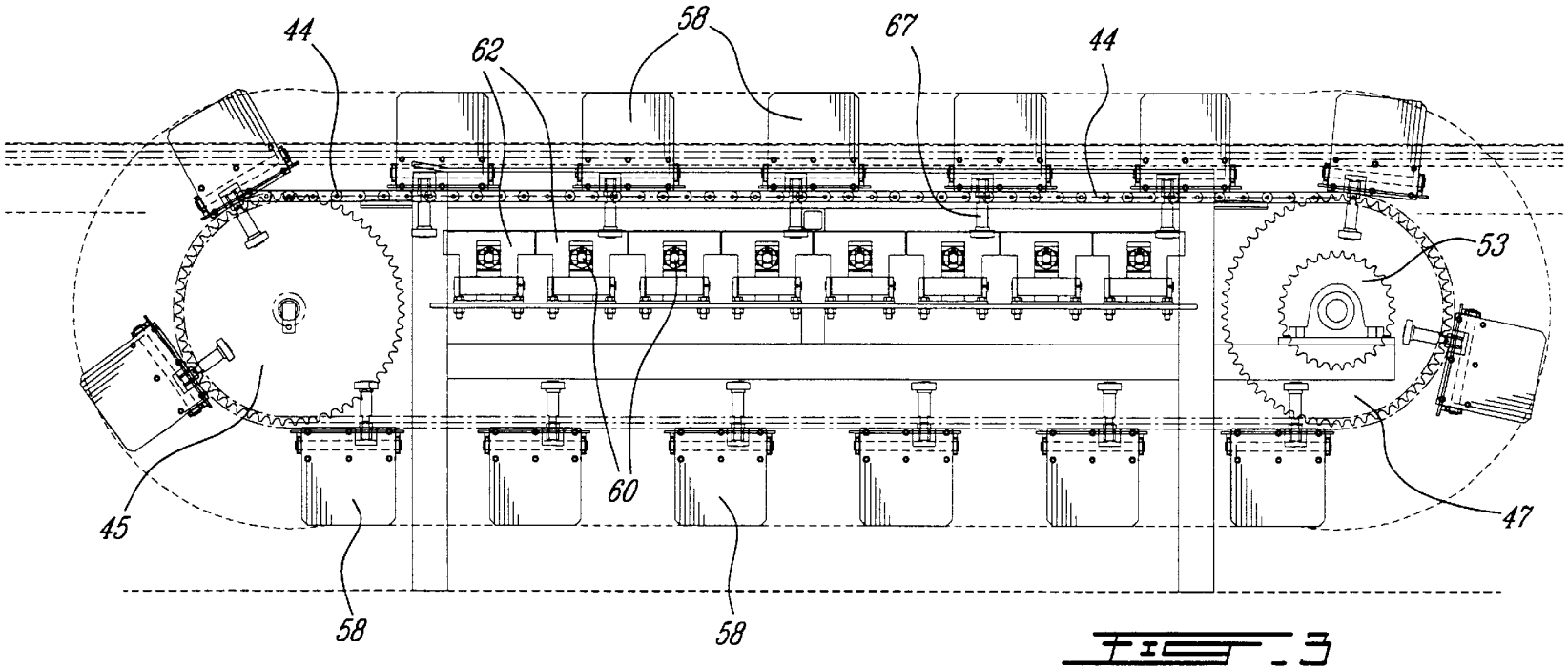
FIG. 3 is a side elevation of the positioning apparatus.

Referring to FIGS. 1, 2 and 3, the positioning apparatus 32 comprises a pair of chains 44 and 46 which are drivingly mounted on sprockets 45 and 47 connected to the head shaft 40, via a chain 48, a universal joint 50 and a chain 52 connected to sprocket 53. The positioner 32 comprises a series of traveling gate mountings 54 that includes a cross piece 56, connected to both chains 44 and 46, and a gate 58 pivoting on supporting plate 69 (FIG. 4).

Each actuating mechanism which controls the position of each gate 58 comprises a pneumatic cylinder 60 supported on a base plate 61 fixed to the positioner frame 70. One end of the cylinder 60 is connected to a guide plate 62. The guide plate 62 is pivotally mounted at 64 to a pivot support 65 also supported by base plate 61. When in the vertical position shown in FIG. 4, guide plate 62 is in contact with a cam roller 66 which is mounted on a lower extension 67 of gate 58, thus forming a rigid assembly which pivots about an axis 68. This axis 68 is mounted on an end section 69 of the cross piece 56 that joins the two chains 44 and 46. Thus, gate 58 as well as its cam roller 66 attached to its extension 67 moves along with chains 44 and 46.

Figure 4:
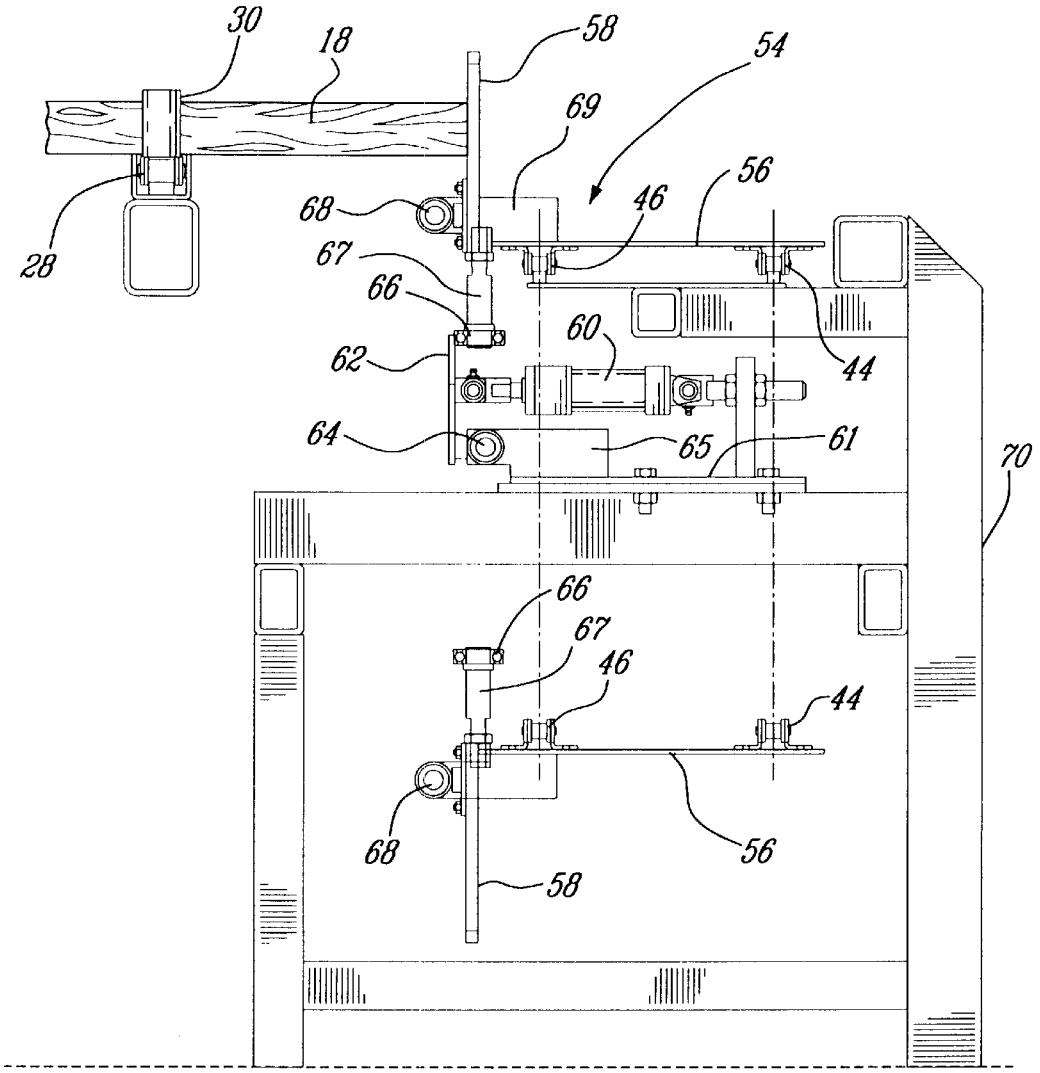
FIG. 4 is a cut-away schematic view of the gates in active and return positions.
Figure 5:
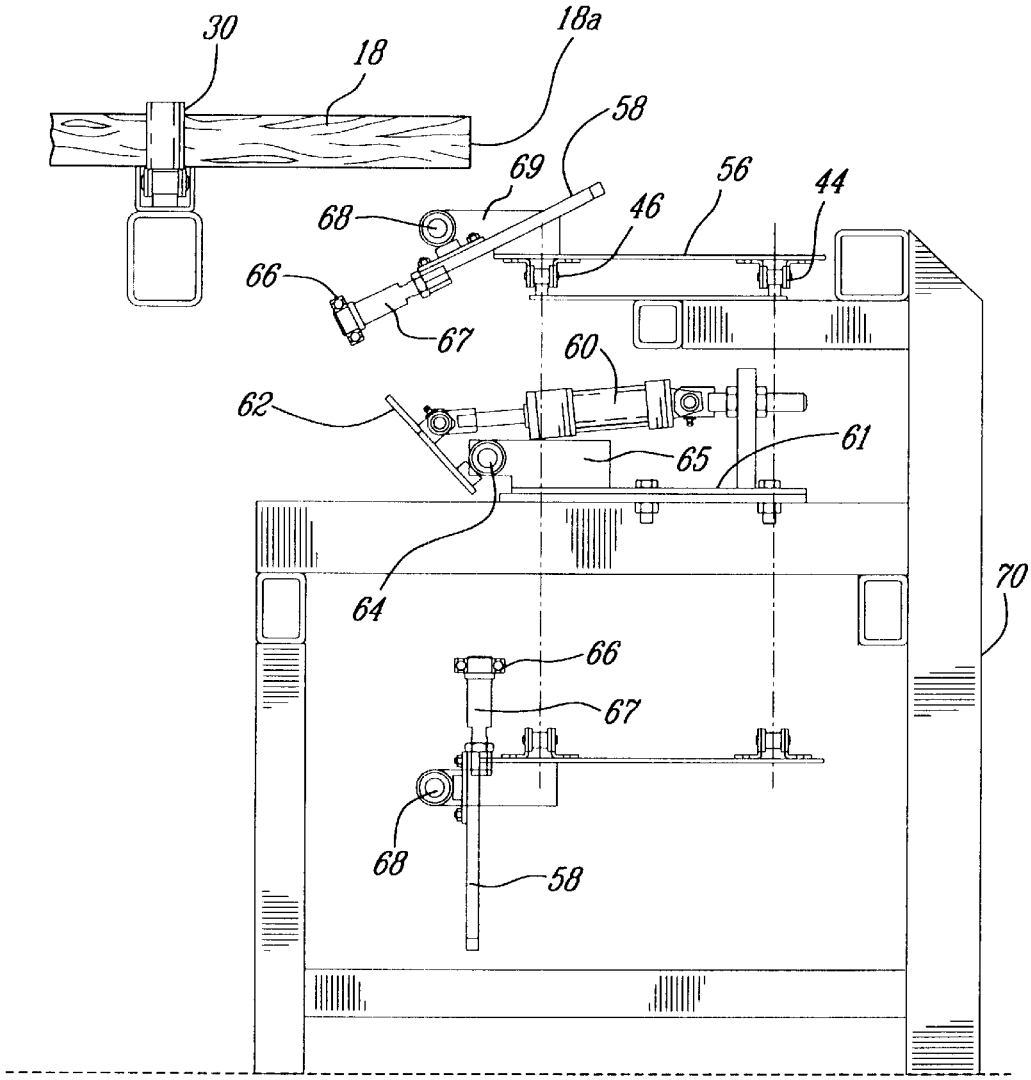
FIG. 5 is a cut-away schematic view of the gates in retracted and return positions.

FIG. 5, which is a figure similar to FIG. 4, shows however positioning gate 58 as having pivoted by gravity about axis 68 to an inclined position. This is achieved after cylinder 60 has caused the guide plate 62 to pivot out of its vertical position about axis 64 thereby freeing cam roller 66 of the positioning gate assembly.

In operation, the lumber pieces 18 brought to the positioning apparatus 32 have previously been placed individually in front of each row of chain lugs 30, brought to the even end line 42 on one side of the scanning section and moved towards the trimming section 16 at a speed synchronized at all times with that of the gates 58 carried by chains 44 and 46 of the positioning apparatus 32. With similar and uniform spacing of the chain lugs 30 and of gates 58, plus adequate speed synchronization (taking into account the converging angle $\alpha$), it is therefore assured that each gate 58 of the positioner will be in alignment with a lumber piece on the transfer section 14 of the trimming station.

If all gates 58 should remain in their vertical position, such as shown in FIG. 3, it is evident that the only result from the operation of the positioner of the present invention would be to push off all lumber pieces from the original even end line 42 to a new even end line 42'(see FIG. 2) whose position would depend on the length of the positioning apparatus 32 and the size of angle $\alpha$. However, FIG. 4 shows gate 58 in the active or "work" position while FIG. 5 shows the gate 58 in the retracted or "no contact" mode. The difference between FIGS. 4 and 5 indicates that a piece of lumber may be pushed axially or left stationary on the conveying chains, from computer signals derived from scanner data. The return position of these gates 58, generally vertical as seen in the lower part of the supporting frame, is similar in both FIGS. 4 and 5.

In FIG. 3, the assembly of cylinder 60 and guide plate 62 is repeated in side by side mountings for the entire working length of the apparatus. Therefore, gate 58 remains vertical as long as the guide plate 62 opposing it, is vertically maintained by cylinder 60, and will continue pushing back axially a lumber piece 18 in line with it. When, however, the lumber piece has reached the correct position, guide plate 62 is pushed back in the inclined position shown in FIG. 5 by the cylinder 60 on receipt of a signal transmitted from the computer. The gate assembly, being no longer guided, assumes an inclined position by gravity due to the location of the pivoting axis 68 relatively to the center of gravity of the gate assembly. In this configuration, gate 58 has no further contact with the end 18*a* of the lumber piece which retains a stable position on its way towards the trimming saws 38.

The saws 38 are set at a fixed spacing (generally one or two feet) from one another and are supported by a pivoting frame actuated by a pneumatic cylinder (not shown) which allows each saw to be lowered or raised on a signal from the computer, depending on whether it is to be in cutting position or not for a particular lumber piece.

Referring again to FIGS. 1 and 2, the sequence of operations taking place during the entire process can be thus stated:

a) Upstream of the trimming station, lumber pieces are being fed one at the time by a distributor unto a lugged chain transfer, and pulled to an even end line on one side of said transfer (not shown).

b) Lugged chains 20 move the lumber between top and bottom heads 26 of scanner 24.

c) Each piece 18 is transferred from lugged chains 20 to lugs 30 of chains 28 and moves transversally along the even end line 42, up to its junction with the travel plane of gates 58.

d) If, according to scanned data for a piece 18, the first gate 58 to coincide with piece 18 at the point of junction is in the retracted position, then the piece will move on to the trimming section 16, following along the same even end line.

e) If gate 58, at the same point as in paragraph 4 above, has been programmed to be in a vertical position, it will enter into contact with piece 18 and will push it back axially as it moves along with the chains, because of the angle of convergence between section 14 and positioning apparatus 32, until the piece reaches the correct position as determined by the computer, at which time gate 58 will retract, leaving the piece stable on the carrying chains of transfer 14.

f) The path then followed by piece 18 until reaching the saws, 38, will be along a straight line parallel to and located anywhere between lines 42 and 42' (FIGS. 1 and 2) as determined by the computer.

g) Further action by the computer will then determine which of the various saws will execute the two end cuts, in view of an optimum solution from the scanned data and the given computer algorithm.

The foregoing description pertains to a main embodiment of a pusher type axial positioner for lumber trimming. The design is, of course, subject to a number of variations and component substitution. For instance, the unit as presently illustrated is designed for a maximum off-setting capacity of one foot from the original even end line 42. This can obviously be increased by lengthening the unit and/or providing a larger converging angle at installation. The chains could be replaced by a single cogged belt of sufficient width and stiffness. Hydraulics could be used instead of pneumatic gate actuators. Also, the entire actuating system could be replaced by a fast acting solenoid actuator directly attached to each of the positioning gates and energized while moving, via commutator tracks mounted in a stationary manner on frame 70.

Similarly, variations in the process heretofore described may be considered in the light of operating experience, in order to bring performance improvements. For example, the application of frictional restraint to suppress axial overtravel of the lumber piece after leaving contact with the gate could be used. It is recognized that such an addition to the process could be desirable, as well as others, whenever operating speeds are pushed to the limit. Such refinements therefore are considered as part of the intent of this invention.

It is therefore wished that this invention should not be limited in interpretation except by the terms of the following claims.

What is claimed is:

1. Apparatus for lengthwise positioning for end trimming of lumber pieces being moved sidewise parallely to one another, even spaced and even ended on one side of a conveying means leading in the direction of a multiple saw trimmer where said lumber pieces are to be end trimmed in accordance with data fed to a computer by a scanner located upstream, said apparatus comprising:

a stationary frame;

a pair of traveling chains mounted on said frame disposed at a converging angle relative to the longitudinal direction of said conveying means and drivingly associated in synchronism with said conveying means;

a series of successive lumber positioning gates fixedly mounted on said traveling chains; said gates being spaced at intervals corresponding to said uniform spacing of the lumber pieces on said conveying means; each said gate having an upper part and a lower part; said upper part being adapted to contact one end of a lumber piece so as to displace said lumber piece axially as said positioning gate is moved by said traveling chains along a line which converges with the direction of movement for said lumber conveying means; said positioning gate being mounted on a horizontal axis to allow tilting from a vertical position to an inclined position; and means responsive to scanner data and computer signals including a series of adjacently disposed guide plates fixedly mounted to said frame and being also mounted to move from a vertical position to a tilted position whereby, in said vertical position, said guide plate contacts said lower part of said positioning gate to maintain said positioning gate in an upright position and in contact with the lumber piece, whereas in a tilted position of said guide plate, said positioning gate also moves to an inclined position whereby a lumber piece is no longer pushed axially and continues to travel in a final position on said conveying means towards said trimmer.

2. Apparatus as defined in claim 1, further comprising roller means mounted on said lower part of said positioning gates to rollably contact said guide plates.

3. Apparatus as defined in claim 1, further comprising pneumatic cylinders connected to said guide plates to move said guide plates from said vertical position to said tilted position and back.

4. Apparatus as defined in claim 1, wherein said positioning gates are caused to tilt out of contact with the lumber piece by the action of gravity, whenever they are not maintained in an upright position by contact of their lower portion with a corresponding guide plate in a vertical position.

* * * * *